United States Patent [19]

Nedelcu

[11] Patent Number: 4,831,675

[45] Date of Patent: May 23, 1989

[54] ORTHOTROPIC STEEL PLATE DECK BRIDGE WITH A DOUBLE RIB SYSTEM

[76] Inventor: Lucian I. Nedelcu, 10 Textbook Ave., Rocky Hill, Conn. 06067

[21] Appl. No.: 194,563

[22] Filed: May 16, 1988

[51] Int. Cl.[4] ..... E01D 19/12

[52] U.S. Cl. ..... 14/73; 14/6

[58] Field of Search ..... 14/1, 3, 4, 6, 13, 17, 14/73; 52/664, 666, 667, 668, 669

[56] References Cited

U.S. PATENT DOCUMENTS

| | | | |
|---|---|---|---|
| 2,128,753 | 8/1938 | Lienhard | 14/73 X |
| 2,645,985 | 7/1953 | Beebe et al. | 14/73 X |
| 2,660,102 | 11/1953 | Tarof | 14/73 X |
| 2,960,919 | 11/1960 | Nagin | 14/73 X |
| 3,066,771 | 12/1962 | Wolchuk | 14/73 X |
| 3,302,361 | 2/1967 | Oudheusden Jr. et al. | 14/73 X |
| 4,102,102 | 7/1978 | Greulich | 14/73 X |
| 4,761,930 | 8/1988 | Tepera | 52/669 |
| 4,780,021 | 10/1988 | Bettigole | 14/73 X |

*Primary Examiner*—Jerome W. Massie
*Assistant Examiner*—Matthew Smith

[57] ABSTRACT

The orthotropic steel plate deck bridge with a double rib system, is a structural steel member with a steel plate deck welded to a closed steel rib which further is welded to an open steel rib. The double rib system has the capacity to transfer the loads from the bridge deck to the steel bridge structure. The double rib system is used for steel bridges particularly for long spans due to its reduced dead load.

8 Claims, 2 Drawing Sheets

ORTHOTROPIC STEEL PLATE DECK BRIDGE WITH A DOUBLE RIB SYSTEM

The present invention is generally related to steel plate decks for bridges, stiffened in one direction by a double rib system and in the perpendicular direction by the steel girders as part of the bridge structure. The steel plate deck works in two orthogonal directions being the top flange for the double rib system in its longitudinal direction, and the top flange for the steel girders which form the bridge structure in the perpendicular direction. The double rib system gives torsional and flexural rigidity to the steel deck plate and allows the use of large spacing between steel ribs and steel girders which make-up the bridge structure.

BACKGROUND OF THE INVENTION

The invention relates to a orthotropic steel plate deck bridge consisting of a combination of steel plate deck, closed ribs and open ribs connected together by welding. The new structural member has a large torsion and flexural rigidity, with a good response to the applied loads and an increased fatigue life expectancy.

Known orthotropic steel plate deck systems have as their objective the use of a steel plate working in two perpendicular directions, reducing the amount of steel required to transfer the applied loads, hence the dead load of the bridge. The steel plate is stiffened by ribs and works as a top flange in the rib's longitudinal direction, and is acting as top flange for the steel girders in the perpendicular direction.

According to the first alternative method, the steel plate deck is welded to an open rib system. The ribs are made of steel and varies in shapes from a simple plate to an invert T form. The structural steel member made-up of steel plate and open ribs has no torsional rigidity and a relatively small flexural rigidity, limiting the spacing between ribs to around 10 inches, and the spacing between transverse steel girders which support the ribs to around 7 feet. The whole system is composed of large numbers of ribs and steel girders, exhibiting poor response to the applied loads and relatively reduced fatigue life expectancy.

According to the second alternative method, the steel plate deck is welded to a closed rib system. The ribs are made of steel and varies in shapes from a rectangular to circular form. The structural steel member made-up of steel plate and closed ribs has relatively large torsional rigidity and a small flexural rigidity, limiting the spacing between transverse steel girders which support the ribs to around 15 feet. The spacing between ribs is limited by the thickness of the steel plate and is around 15 inches. The whole system is composed of large number of ribs, having an inadequate fatigue life expectancy.

To overcome the shortcomings of the existing methods, the present invention is developed to produce an orthotropic steel plate deck bridge with large torsional and flexural rigidity, with improved response to the applied loads and with an prolonged fatigue life expectancy of the deck. The double rib system also uses a reduced quantity of steel per square foot of bridge deck, is easier to fabricate and its adequate for field splicing.

SUMMARY OF THE INVENTION

The present invention represents a double rib system for the orthotropic steel plate deck bridges which increases the torsional and flexural stiffenes improving the response of the steel structure to the applied loads and extending the fatigue life expectancy of the bridge deck.

To achieve these purposes, the steel plate deck is welded to a closed steel rib which farther is connected at its lower part to an open steel rib. The new structural member, made-up of the steel plate deck acting as a top flange, the closed steel rib conferring the torsional rigidity to the system and the open steel rib acting as web and bottom flange for the double steel rib. The built-up structural steel member exhibits large torsional and flexural rigidity.

Another objective of this invention is to produce a rigid structural steel member, with limited end rotations, hence an improved fatigue life expectancy for the steel deck.

Another objective of this invention is to obtain a rib system for the orthotropic steel plate deck bridges with bigger flexural rigidity, hence a smaller spacing between the transverse steel girders supporting the double rib system.

Another objective of this invention is to reduce the fabrication cost of the orthotropic steel plate deck bridge.

Another objective of this invention is to reduce the amount of steel used for orthotropic steel plate deck bridges, hence the dead load of the steel bridge.

A further objective of this invention is to provide a reduce and structurally simplified number of field splices for the steel ribs.

A further objective of this invention is to reduce the erection cost of the orthotropic steel plate deck bridges.

A further objective of this invention is to reduce the size of the bearings, the dimension of the substructure and their costs.

A further objective of this invention is to extend the length of the span that can be built, for steel bridges.

BRIEF DESCRIPTION OF THE DRAWINGS

Other objectives and advantages of this invention will become more apparent from the specifications taken in conjunction with the accompanying drawings in which.

DETAILED DESCRIPTION OF THE INVENTION

Figure 1:
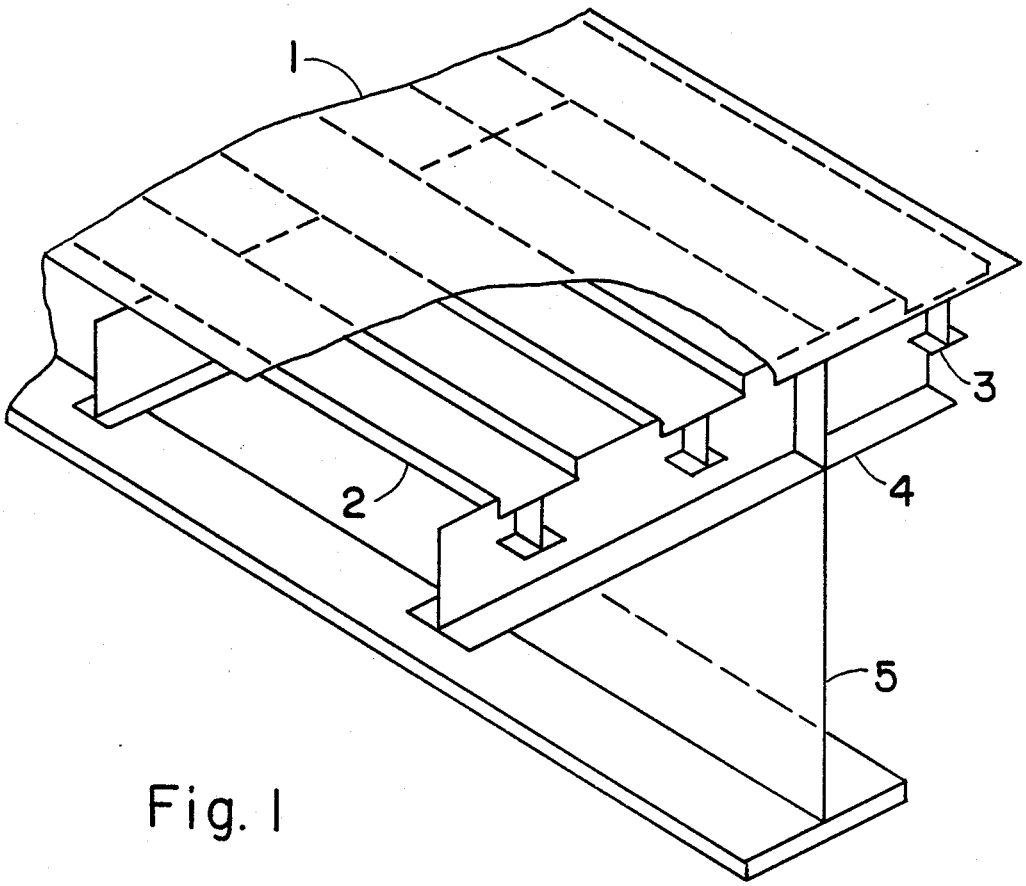
FIG. 1 represents a perspective view of the orthotropic steel plate deck bridge with a double rib system and with I type longitudinal and transverse steel structural members

Referring to the drawing shown in FIG. 1, numeral 1 designates a steel plate deck, numeral 2 designates a closed steel rib, welded to the steel plate, numeral 1, numeral 3 designates a open steel rib, welded to the closed steel rib at the top, numeral 4 designates a steel girder which supports the steel ribs and having a perpendicular direction to the steel ribs, and numeral 5 designates another steel girder, as part of the steel bridge structure and having a parallel direction to the steel ribs. The double rib system is a combination of the three steel members, the steel plate, numeral 1, the closed steel rib, numeral 2, and the open steel rib, numeral 3. The double rib system is welded to a steel girder, numeral 4, which can be either an inverted T type or a box type member. The steel girder, numeral 4, has as a top flange the steel plate, numeral 1, which works in two perpendicular directions. For large structures, the steel girders, numeral 4, are supported by a another steel girders, numeral 5, having an orthogonal direction. In this case the double rib system is parallel to the steel girders, numeral 5, and is acting as a top flange for these steel girders, numeral 5. The steel girder, numeral 5 can also be either an inverted T type or box type member.

Figure 2:
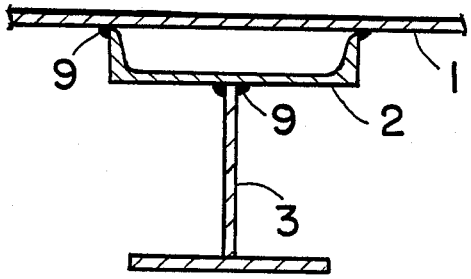
FIG. 2 represents a cross section of the orthotropic steel plate deck bridge with a double rib system, using a channel for the closed rib and an inverted T for the open rib

The drawing shown in FIG. 2 represents an example of a cross section of the double rib system where, the steel plate, numeral 1, is connected to the top of a channel which forms the closed steel rib, numeral 2, by welding, numeral 9, and the closed steel rib, numeral 2, is connected to the top of the open steel rib, numeral 3, by welding, numeral 9.

Figure 3:
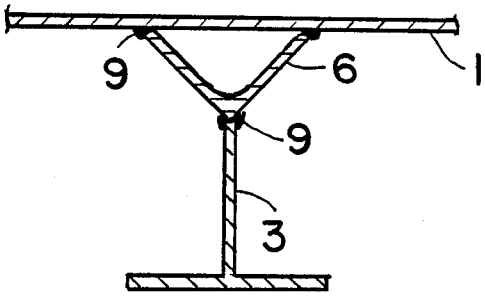
FIG. 3 represents a cross section of the orthotropic steel plate deck bridge with a double rib system, using an angle for the closed rib and an inverted T for the open rib

The drawing shown in FIG. 3 represents another example of a cross section of the double rib system where, the steel plate, numeral 1, is connected to the top of an angle which forms the closed steel rib, numeral 6, by welding numeral 9, and the closed steel rib, numeral 6, is connected to the top of the open steel rib, numeral 3, by welding, numeral 9.

Figure 4:
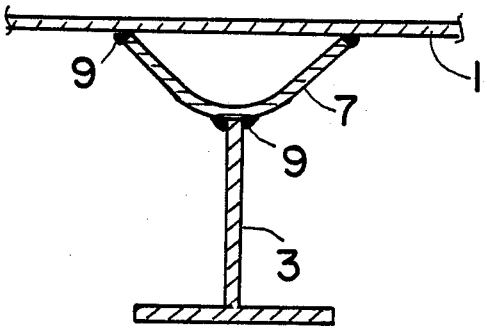
FIG. 4 represents a cross section of the orthotropic steel plate deck bridge with a double rib system, using a steel plate bent in a V form for the closed rib and an inverted T for the open rib

The drawing shown in FIG. 4 represents another example of a cross section of the double rib system where, the steel plate, numeral 1, is connected to the top of an angle which forms the closed steel rib, numeral 7, by welding, numeral 9, and the closed steel rib, numeral 7, is connected to the top of the open steel rib, numeral 3, by welding, numeral 9.

Figure 5:
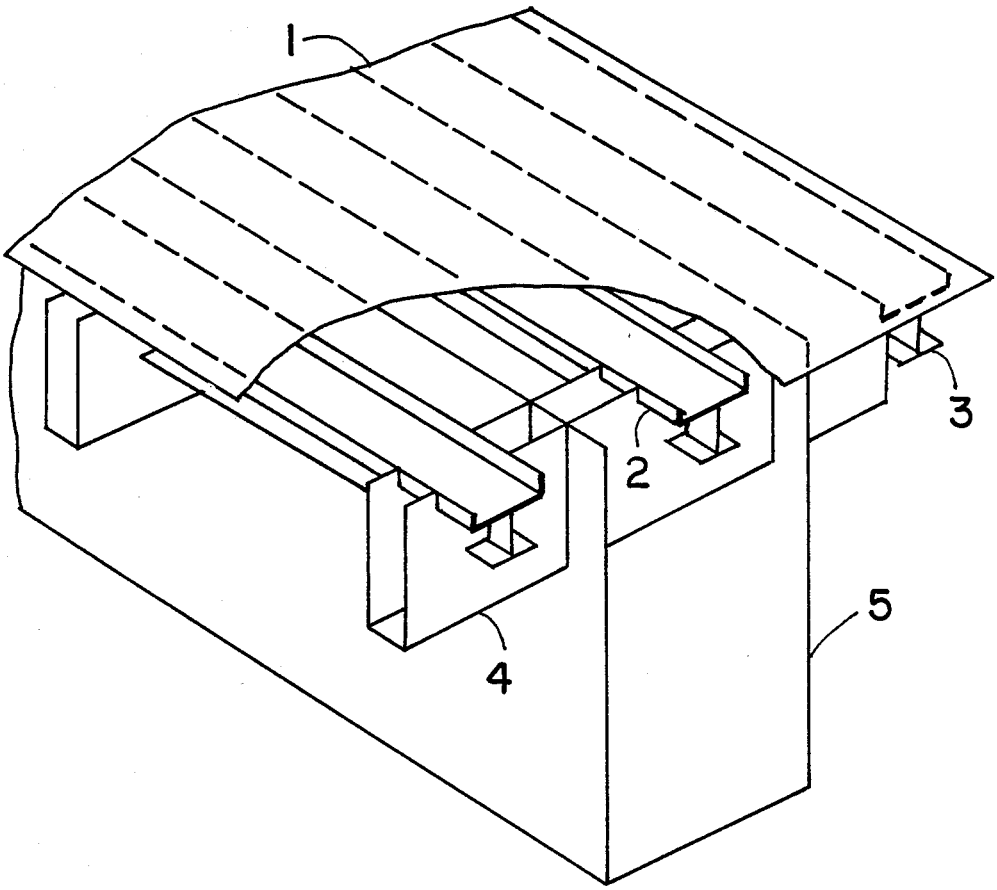
FIG. 5 represents a perspective view of the orthotropic steel plate deck bridge with a double rib system and with U type longitudinal and transverse steel structural members.

The drawing shown in FIG. 5 is similar with the drawing shown in FIG. 1 with one difference, that the longitudinal and transverse structural members have a U shape instead of a I shape, as shown in FIG. 1.

The drawings contain all the elements necessary for a diversified utilization of the orthotropic steel plate deck bridge with a double rib system and it is evident that some of them may be either omitted or added in specific cases.

It is obvious that the invention is not limited exclusively to the embodiments illustrated and that many modifications can be made in the form, the disposition, and the nature of some of the elements used in carrying the invention into effect, provided that these modifications do not conflict with the provisions contained in each of the following claims.

I claim:

1. A double rib system for the orthotropic steel plate deck bridges comprising:

a steel plate;

longitudinally extending steel members defined as closed ribs welded to said steel plate in such a manner to form rows inverted T steel members defined as open ribs welded longitudinally at the bottom of said closed ribs forming parallel rows and creating a double rib system transversely extending steel girders having an inverted T shape, welded to said steel plate having openings for and welded to said double ribs;

longitudinally extending steel girders having an inverted T shape, welded to said steel plate having openings for and and welded to said transversely extending steel girders.

2. The double rib system of claim 1, wherein the close steel rib is a standard steel channel.

3. The double rib system of claim 1, wherein the close steel rib is a standard steel angle.

4. The double rib system of claim 1, wherein the close steel rib is a steel plate bent in a V form.

5. A double rib system for the orthotropic steel plate deck bridges comprising:

a steel plate;

longitudinally extending steel members defined as closed ribs welded to said steel plate in such a manner to form rows inverted T steel members defined as open ribs welded longitudinally at the bottom of said closed ribs forming parallel rows and creating a double rib system transversely extending steel girders having an U shape, welded to said steel plate and having openings for the said double ribs;

longitudinally extending steel girders having an U shape, welded to said steel plate having openings for and said transversely extending steel girders.

6. The double rib system of claim 5, wherein the close steel rib is a standard steel channel.

7. The double rib system of claim 5, wherein the close steel rib is a standard steel angle.

8. The double rib system of claim 5, wherein the close steel rib is a steel plate bent in a V form.

* * * * *